US007165553B2

(12) United States Patent
Luan et al.

(10) Patent No.: US 7,165,553 B2
(45) Date of Patent: Jan. 23, 2007

(54) NANOSCALE CATALYST PARTICLES/ALUMINOSILICATE TO REDUCE CARBON MONOXIDE IN THE MAINSTREAM SMOKE OF A CIGARETTE

(75) Inventors: Zhaohua Luan, Midlothian, VA (US); Jay A Fournier, Richmond, VA (US); Sarojini Deevi, Midlothian, VA (US); Ila Skinner, Chester, VA (US); Kent B. Koller, Chesterfield, VA (US); Diane L. Gee, Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 327 days.

(21) Appl. No.: 10/460,632

(22) Filed: Jun. 13, 2003

(65) Prior Publication Data

US 2004/0250828 A1 Dec. 16, 2004

(51) Int. Cl.
*A24B 15/18* (2006.01)

(52) U.S. Cl. ..... 131/334; 131/360; 131/364; 131/365; 162/139; 162/158; 162/164.2; 162/164.4

(58) Field of Classification Search ..... 131/364, 131/334, 360, 365; 162/139, 158, 164.2, 162/164.4
See application file for complete search history.

(56) References Cited

U.S. PATENT DOCUMENTS

| | | | | |
|---|---|---|---|---|
| 3,292,636 | A | | 12/1966 | Mays |
| 3,572,348 | A | * | 3/1971 | Norman et al. ..... 131/352 |
| 3,703,901 | A | | 11/1972 | Williams et al. |
| 3,720,214 | A | | 3/1973 | Norman et al. |
| 3,807,416 | A | | 4/1974 | Hedge et al. |
| 3,931,824 | A | | 1/1976 | Miano et al. |
| 4,108,151 | A | | 8/1978 | Martin et al. |
| 4,109,663 | A | | 8/1978 | Maeda et al. |
| 4,119,104 | A | | 10/1978 | Roth |
| 4,182,348 | A | | 1/1980 | Seehofer et al. |
| 4,195,645 | A | | 4/1980 | Bradley, Jr. et al. |
| 4,197,861 | A | | 4/1980 | Keith |
| 4,256,609 | A | | 3/1981 | Dale et al. |
| 4,317,460 | A | | 3/1982 | Dale et al. |
| 4,450,847 | A | | 5/1984 | Owens |
| 4,453,553 | A | | 6/1984 | Cohn |
| 4,489,739 | A | | 12/1984 | Mattina, Jr. et al. |
| 4,744,374 | A | | 5/1988 | Deffeves et al. |
| 4,956,330 | A | | 9/1990 | Elliott et al. |
| 5,050,621 | A | | 9/1991 | Creighton et al. |
| 5,101,839 | A | | 4/1992 | Jakob et al. |
| 5,105,836 | A | | 4/1992 | Gentry et al. |
| 5,129,408 | A | | 7/1992 | Jakob et al. |
| 5,211,684 | A | | 5/1993 | Shannon et al. |
| 5,258,340 | A | | 11/1993 | Augustine et al. |
| 5,284,166 | A | | 2/1994 | Cartwright et al. |
| 5,322,075 | A | | 6/1994 | Deevi et al. |
| 5,378,665 | A | | 1/1995 | Chen et al. |
| 5,386,838 | A | | 2/1995 | Quincy, III et al. |
| 5,446,003 | A | | 8/1995 | Augustine et al. |
| 5,591,368 | A | | 1/1997 | Fleischhauer et al. |
| 5,598,868 | A | | 2/1997 | Jakob et al. |
| 5,671,758 | A | | 9/1997 | Rongved |
| 5,728,462 | A | | 3/1998 | Arino et al. |
| 5,934,289 | A | | 8/1999 | Watkins et al. |
| 6,053,176 | A | | 4/2000 | Adams et al. |
| 6,074,979 | A | | 6/2000 | Hagemeyer et al. |
| 6,083,467 | A | | 7/2000 | Takeshima et al. |
| 6,095,152 | A | | 8/2000 | Beven et al. |
| 6,138,684 | A | | 10/2000 | Yamazaki et al. |
| 6,235,677 | B1 | | 5/2001 | Manzer et al. |
| 6,276,132 | B1 | | 8/2001 | Kanesaka et al. |
| 6,286,516 | B1 | | 9/2001 | Bowen et al. |
| 6,299,778 | B1 | | 10/2001 | Penth et al. |
| 6,361,660 | B1 | | 3/2002 | Goldstein |
| 6,371,127 | B1 | | 4/2002 | Snaidr et al. |
| 6,410,765 | B1 | | 6/2002 | Wellinghoff et al. |

(Continued)

FOREIGN PATENT DOCUMENTS

| | | | |
|---|---|---|---|
| EP | 0499402 | A | 8/1992 |
| GB | 2013476 | A | 8/1979 |
| WO | 87/06104 | A1 | 10/1987 |
| WO | 98/51401 | A1 | 11/1998 |
| WO | 99/16546 | A1 | 4/1999 |
| WO | 00/40104 | A1 | 7/2000 |
| WO | 02/24005 | A2 | 3/2002 |

OTHER PUBLICATIONS

International Search Report and Written Opinion for PCT/IB2004/002158 dated Nov. 29, 2004.

(Continued)

*Primary Examiner*—Dionne W. Mayes
(74) *Attorney, Agent, or Firm*—Buchanan Ingersoll & Rooney PC

(57) ABSTRACT

A smoking article composition and a method of making a smoking article composition comprising tobacco cut filler, cigarette paper and/or cigarette filter material further comprising a catalyst capable of converting carbon monoxide to carbon dioxide, wherein the catalyst comprises nanoscale catalyst particles dispersed within a porous aluminosilicate matrix. The catalyst can be formed by combining nanoscale catalyst particles or a metal precursor solution thereof with an alumina-silica sol mixture to form a slurry, gelling the slurry to form the co-gel, heating the co-gel to form a catalyst comprising nanoscale catalyst particles dispersed within a porous aluminosilicate matrix. The catalyst can be incorporated in tobacco cut filler, cigarette paper and/or cigarette filter material by spraying, dusting and/or immersion.

48 Claims, No Drawings

U.S. PATENT DOCUMENTS

| | | | | |
|---|---|---|---|---|
| 2002/0002979 | A1 | 1/2002 | Bowen | |
| 2002/0062834 | A1 | 5/2002 | Snaidr et al. | |
| 2003/0037792 | A1 | 2/2003 | Snaidr et al. | |
| 2004/0173229 | A1* | 9/2004 | Crooks et al. | 131/359 |

OTHER PUBLICATIONS

Morris et al., "Silica Sol as a Nanoglue: Flexible Synthesis of Composite Aerogels," *Science*, Apr. 23, 1999, pp. 622-632, vol. 284, American Association for the Advancement of Science, Washington, D.C.

Iijima et al., "Single-shell carbon nanotubes of 1-nm diameter", *Nature*, Jun. 17, 1993, pp. 603-605, vol. 363, Nature Publishing Group, London, England.

Dagani, "Architectural Tour of the Nano World", *Chemical and Engineering News—Science/Technology*, Sep. 21, 1998, pp. 70-77, vol. 76, No. 38, American Chemical Society, Washington, D.C.

International Preliminary Report on Patentability dated Dec. 13, 2005 for PCT/IB2004/002158.

* cited by examiner

NANOSCALE CATALYST PARTICLES/ALUMINOSILICATE TO REDUCE CARBON MONOXIDE IN THE MAINSTREAM SMOKE OF A CIGARETTE

FIELD OF THE INVENTION

The invention relates generally to methods for reducing constituents such as carbon monoxide in the mainstream smoke of a cigarette during smoking. More specifically, the invention relates to cut filler compositions, cigarettes, methods for making cigarettes and methods for smoking cigarettes, which involve the use of nanoparticle additives capable of reducing the amounts of various constituents in tobacco smoke.

BACKGROUND OF THE INVENTION

In the description that follows reference is made to certain structures and methods, however, such references should not necessarily be construed as an admission that these structures and methods qualify as prior art under the applicable statutory provisions. Applicants reserve the right to demonstrate that any of the referenced subject matter does not constitute prior art.

Smoking articles, such as cigarettes or cigars, produce both mainstream smoke during a puff and sidestream smoke during static burning. One constituent of both mainstream smoke and sidestream smoke is carbon monoxide (CO). The reduction of carbon monoxide in smoke is desirable.

Catalysts, sorbents, and/or oxidants for smoking articles are disclosed in the following: U.S. Pat. No. 6,371,127 issued to Snider et al., U.S. Pat. No. 6,286,516 issued to Bowen et al., U.S. Pat. No. 6,138,684 issued to Yamazaki et al., U.S. Pat. No. 5,671,758 issued to Rongved, U.S. Pat. No. 5,386,838 issued to Quincy, III et al., U.S. Pat. No. 5,211,684 issued to Shannon et al., U.S. Pat. No. 4,744,374 issued to Deffeves et al., U.S. Pat. No. 4,453,553 issued to Cohn, U.S. Pat. No. 4,450,847 issued to Owens, U.S. Pat. No. 4,182,348 issued to Seehofer et al., U.S. Pat. No. 4,108,151 issued to Martin et al., U.S. Pat. No. 3,807,416, and U.S. Pat. No. 3,720,214. Published applications WO 02/24005, WO 87/06104, WO 00/40104 and U.S. Patent Application Publication Nos. 2002/0002979 A1, 2003/0037792 A1 and 2002/0062834 A1 also refer to catalysts, sorbents, and/or oxidants.

Iron and/or iron oxide has been described for use in tobacco products (see e.g., U.S. Pat. Nos. 4,197,861; 4,489,739 and 5,728,462). Iron oxide has been described as a coloring agent (e.g. U.S. Pat. Nos. 4,119,104; 4,195,645; 5,284,166) and as a burn regulator (e.g. U.S. Pat. Nos. 3,931,824; 4,109,663 and 4,195,645) and has been used to improve taste, color and/or appearance (e.g. U.S. Pat. Nos. 6,095,152; 5,598,868; 5,129,408; 5,105,836 and 5,101,839).

Despite the developments to date, there remains a need for improved and more efficient methods and compositions for reducing the amount of carbon monoxide in the mainstream smoke of a smoking article during smoking.

SUMMARY

A smoking article composition is provided comprising tobacco cut filler, cigarette paper and/or cigarette filter material further comprising a catalyst capable of converting carbon monoxide to carbon dioxide, wherein the catalyst comprises nanoscale catalyst particles dispersed within a porous aluminosilicate matrix.

Also provided is a method of making a smoking article composition comprising tobacco cut filler, cigarette paper and/or cigarette filter material further comprising a catalyst, comprising the steps of (i) combining nanoscale catalyst particles or a metal precursor solution thereof with a alumina-silica sol mixture to form a slurry, (ii) gelling the slurry to form a co-gel, (iii) heating the co-gel to form a catalyst comprising nanoscale catalyst particles dispersed within a porous aluminosilicate matrix; and (iv) incorporating the catalyst in tobacco cut filler, cigarette paper and/or cigarette filter material.

A preferred embodiment provides a cigarette and a method of making a cigarette comprising the steps of (i) supplying tobacco cut filler to a cigarette making machine to form a tobacco column; and (ii) placing cigarette paper around the tobacco column to form a tobacco rod of the cigarette, wherein at least one of the tobacco cut filler and cigarette paper contain nanoscale catalyst particles dispersed within a porous aluminosilicate matrix.

The nanoscale catalyst particles may comprise a metal and/or a metal oxide. Preferably, the nanoscale catalyst particles may comprise a Group IIIB element, a Group IVB element, a Group IVA element, a Group VA element, a Group VIA element, a Group VIIA element, a Group VIIIA element, a Group IB element, magnesium, zinc, yttrium, rare earth metals such as cerium, and mixtures thereof. Most preferably, the nanoscale catalyst particles comprise iron oxide and/or iron oxide hydroxide. The nanoscale catalyst particles are preferably carbon-free and may have an average particle size less than about 50 nm, preferably less than about 10 nm. The nanoscale catalyst particles may have a crystalline and/or amorphous structure.

The aluminosilicate matrix may further comprise magnesia, titania, yttria, ceria or mixtures thereof. The structure of the aluminosilicate matrix may be crystalline and/or amorphous. Preferably, the matrix has an average pore size of between about 1 nanometer and 100 nanometers and/or an average surface area of from about 20 to 2500 $m^2/g$.

A preferred smoking article composition comprises a catalyst comprising from about 1 to 50 wt. % iron oxide particles. Preferably, the smoking article composition comprises the catalyst in an amount effective to reduce the ratio of carbon monoxide to total particulate matter in mainstream smoke by at least 25%. The catalyst may be capable of acting as an oxidant for the conversion of carbon monoxide to carbon dioxide.

According to a preferred method of making the catalyst, the metal precursor can be selected from the group consisting of β-diketonates, dionates, oxalates and hydroxides. The metal precursor solution may comprise one or more elements selected from a Group IIIB element, a Group IVB element, a Group IVA element, a Group VA element, a Group VIA element, a Group VIIA element, a Group VIIIA element, a Group IB element, magnesium, zinc, yttrium, and rare earth metals such as cerium.

The alumina-silica sol mixture may further comprise one or more sols selected from the group consisting of magnesia, titania, yttria and/or ceria. The alumina-silica sol mixture preferably comprises an aluminum source selected from the group consisting of aluminum nitrate, aluminum chloride and aluminum sulfate and a silicon source selected from the group consisting of silica hydrogels, silica sols, colloidal silica, fumed silica, silicic acid and silanes.

The step of forming the slurry and gelling the slurry may be performed simultaneously. The step of gelling the slurry may be conducted at a pH of at least about 7 such as by adding a ammonium hydroxide to the slurry to bring the pH in a range of from between about 8 to 11. Preferably, the step of gelling the slurry is conducted at a temperature of less than about 100° C.

The co-gel is preferably heated at a temperature in the range of from about 200° C. to 500° C., preferably at a temperature sufficient to thermally decompose the metal precursor to form nanoscale catalyst particles. Optionally the catalyst can be calcined by heating the catalyst powder at a temperature in the range of from about 425° C. to 750° C.

The catalyst can be incorporated in tobacco cut filler, cigarette paper and/or cigarette filter material using spray coating, dusting and/or immersion.

Also provided is a method of smoking a cigarette, comprising lighting the cigarette to form tobacco smoke and drawing the tobacco smoke through the cigarette, wherein during the smoking of the cigarette the catalyst reduces the amount of carbon monoxide in the tobacco smoke.

DETAILED DESCRIPTION OF PREFERRED EMBODIMENTS

A smoking article composition is provided wherein tobacco cut filler, cigarette paper and/or cigarette filter material incorporates a catalyst capable of converting carbon monoxide to carbon dioxide, wherein the catalyst comprises nanoscale catalyst particles dispersed within a porous aluminosilicate matrix. A further embodiment relates to a method of making such a smoking article composition by (i) combining nanoscale catalyst particles or a metal precursor solution thereof with an alumina-silica sol mixture to form a slurry, (ii) gelling the slurry to form a co-gel, (iii) heating the co-gel to form a catalyst comprising nanoscale catalyst particles dispersed within a porous aluminosilicate matrix; and (iv) incorporating the catalyst in tobacco cut filler, cigarette paper and/or cigarette filter material.

The catalyst, which may also function as an oxidant for the conversion of carbon monoxide to carbon dioxide, can reduce the amount of carbon monoxide in mainstream smoke during smoking, thereby also reducing the amount of carbon monoxide reaching the smoker and/or given off as second-hand smoke. A catalyst is capable of affecting the rate of a chemical reaction, e.g., increasing the rate of oxidation of carbon monoxide to carbon dioxide and/or increasing the rate of reduction of nitric oxide to nitrogen without participating as a reactant or product of the reaction. An oxidant is capable of oxidizing a reactant, e.g., by donating oxygen to the reactant, such that the oxidant itself is reduced.

The catalyst preferably comprises metal and/or metal oxide nanoscale catalyst particles as an active catalyst that are dispersed in a porous aluminosilicate matrix. Preferably the aluminosilicate matrix is thermally stable. Advantageously, by dispersing the nanoscale catalyst particles within the aluminosilicate matrix, the matrix can reduce aggregation or sintering of the nanoscale catalyst particles to each other before incorporating the nanoscale catalyst particles into the smoking article composition and/or during smoking. Aggregation and/or sintering of the nanoscale catalyst particles can result in a loss of active surface area of the catalyst. The aluminosilicate matrix can also reduce migration of the nanoscale catalyst particles into the smoking article composition.

A general formula, by weight, for the catalyst is: 1–90% metal and/or metal oxide nanoparticles; preferably less than about 50%; more preferably less than about 25% metal and/or metal oxide nanoparticles, and 10–99% porous aluminosilicate matrix; preferably at least about 50%; more preferably at least about 75% porous aluminosilicate matrix.

A preferred catalyst comprises a porous aluminosilicate matrix containing metal and/or metal oxide nanoparticles made using the technique of co-gelation. Nanoscale catalyst particles or a metal precursor solution can be combined with an alumina-silica sol mixture to form a slurry and the slurry can be gelled and then heated to form a powder catalyst comprising nanoscale catalyst particles dispersed within the aluminosilicate matrix. The catalyst, which can be in powder form or combined with a solvent to form a paste or dispersion, can be incorporated in tobacco cut filler, cigarette paper and/or cigarette filter material.

By way of example, the aluminosilicate matrix can be prepared from an alumina source and a silica source that are mixed to form an alumina-silica sol mixture at a pH of at least about 7, preferably from about 8 to 11, in proportions providing an alumina:silica ratio in a range of about 1 to 99% by weight. As described below, the alumina and silica sources are preferably liquids or dispersed solids, e.g., sols or colloidal suspensions, which can be combined by adding them to a vessel sequentially or simultaneously at constant or variable flow rates.

According to a preferred method, nanoscale catalyst particles of metal and or/metal oxide can be dispersed within an alumina-silica sol mixture and the resulting slurry can be gelled though condensation reactions under basic conditions, for example, by addition of ammonium hydroxide. The gel can be maintained at a pH of at least about 7 and at a temperature of between from about 0° C. to 100° C., preferably about 40° C. to 80° C., until the reaction between the alumina and silica sources is complete. Thus, a co-gelled matrix is prepared via the simultaneous condensation of two or more sols, colloidal suspensions, aqueous salts and/or dispersions, which comprise the constituents used to form the matrix. The resulting aluminosilicate co-gel, which comprises a dispersion of nanoscale catalyst particles, can be dried at about 80° C. to 400° C., preferably about 100° C. to 200° C., and optionally calcined to crystallize or partially crystallize the aluminosilicate matrix. The nanoscale catalyst particle-porous aluminosilicate matrix catalyst material can be incorporated into a smoking article composition or a process for making a smoking article composition.

The structure of aluminosilicates comprises tetrahedra of oxygen atoms surrounding a central cation, usually silicon, and octahedra of oxygen atoms surrounding a different cation of lesser valency, usually aluminum. The structures that result are complex 3-D porous frameworks having precisely dimensioned channels running through the structure. These channels enable aluminosilicates to be selectively permeable to various gases or liquids.

The porous aluminosilicate matrix is preferably characterized by a BET surface area of at least about 50 $m^2/g$ and up to about 2,500 $m^2/g$ with pores having an average pore size of at least about 1 nanometer and up to about 100 nanometers.

The matrix material may further include magnesia, titania, yttria, ceria and combinations thereof, including silica-alumina-titania, silica-magnesia, silica-yttria and silica-alumina-zirconia.

According to a first embodiment, the nanoscale catalyst particles can comprise commercially available metal or metal oxide nanoscale catalyst particles that comprise Group IIIB elements (B, Al); Group IVB elements (C, Si, Ge, Sn); Group IVA elements (Ti, Zr, Hf); Group VA elements (V, Nb, Ta); Group VIA elements (Cr, Mo, W), Group VIIA (Mn, Re), Group VIIIA elements (Fe, Co, Ni, Ru, Rh, Pd, Os, Ir, Pt); Group IB elements (Cu, Ag, Au), Mg, Zn, Y, rare earth metals such as Ce, and mixtures thereof. For example, preferred nanoscale catalyst particles include Fe, Ni, Pt, Cu and Au. Preferred nanoscale oxide particles include titania, iron oxide, copper oxide, silver oxide and cerium oxide.

Nanoscale particles such as nanoscale catalyst particles have an average grain or other structural domain size below about 100 nanometers. The nanoscale catalyst particles can have an average particle size less than about 100 nm, preferably less than about 50 nm, more preferably less than about 10 nm, and most preferably less than about 7 nm. Nanoscale catalyst particles have very high surface area to volume ratios that makes them attractive for catalytic applications. For example, nanoscale iron oxide particles can exhibit a much higher percentage of conversion of carbon monoxide to carbon dioxide than larger, micron-sized iron oxide particles.

The nanoscale catalyst particles preferably comprise nanoscale iron oxide particles. For instance, MACH I, Inc., King of Prussia, Pa. sells nanoscale iron oxide particles under the trade names NANOCAT® Superfine Iron Oxide (SFIO) and NANOCAT® Magnetic Iron Oxide. The NANOCAT® Superfine Iron Oxide (SFIO) is amorphous ferric oxide in the form of a free flowing powder, with a particle size of about 3 nm, a specific surface area of about 250 $m^2/g$, and a bulk density of about 0.05 g/ml. The NANOCAT® Superfine Iron Oxide (SFIO) is synthesized by a vapor-phase process, which renders it free of impurities that may be present in conventional catalysts, and is suitable for use in food, drugs, and cosmetics. The NANOCAT® Magnetic Iron Oxide is a free flowing powder with a particle size of about 25 mn and a surface area of about 40 $m^2/g$.

Nanoscale catalyst particles of iron oxide are a preferred constituent in the catalyst because iron oxide can have a dual function as a CO catalyst in the presence of oxygen and as a CO oxidant for the direct oxidation of CO in the absence of oxygen. A catalyst that can also be used as an oxidant is especially useful for certain applications, such as within a burning cigarette where the partial pressure of oxygen can be very low.

A catalyst is capable of affecting the rate of a chemical reaction, e.g., increasing the rate of oxidation of carbon monoxide to carbon dioxide and/or increasing the rate of reduction of nitric oxide to nitrogen without participating as a reactant or product of the reaction. An oxidant is capable of oxidizing a reactant, e.g., by donating oxygen to the reactant, such that the oxidant itself is reduced.

According to a second embodiment, a catalyst comprises nanoscale catalyst particles that are formed in situ within the porous aluminosilicate matrix such as by using molecular organic decomposition. The process of molecular organic decomposition is described in further detail below. According to this embodiment, the catalyst is prepared by co-gelation of an aluminosilicate matrix together with a solution of a metal precursor compound. A suitable metal precursor compound, for example, gold hydroxide, silver pentane dionate, copper pentane dionate, copper oxalate-zinc oxalate, titanium pentane dionate, iron pentane dionate or iron oxalate can be dissolved in a solvent such as alcohol and mixed with, for example, a silicon source and an aluminum source. The aluminum and silicon sources in the mixture can be co-gelled as described above, and during or after gelation the co-gel can be heated to a relatively low temperature, for example 200° C. to 400° C., wherein thermal decomposition of the metal precursor compound results in the formation of nanoscale metal and/or metal oxide particles dispersed within a porous aluminosilicate matrix. The resulting powder catalyst can be optionally calcined to crystallize or partially crystallize the nanoscale catalyst particles and/or the aluminosilicate matrix. The catalyst, which can be in the form of a powder, or combined with a solvent to form a paste or dispersion, can be incorporated into a smoking article or a process for making a smoking article.

A variety of compounds can be used as alumina and silica sources for the aluminosilicate matrix. An alumina source is preferably a soluble aluminum salt, such as aluminum nitrate, aluminum chloride or aluminum sulfate. A silica source can be selected from silica hydrogels, silica sols, colloidal silica, fumed silica, silicic acid and silanes. A silica dispersion, such as silica sols or colloidal silica, can be any suitable concentration such as, for example, 10 to 60 wt. %, e.g., a 15 wt. % dispersion or a 40 wt. % dispersion.

Silica hydrogel, also known as silica aquagel, is a silica gel formed in water. The pores of a silica hydrogel are filled with water. An xerogel is a hydrogel with the water removed. An aerogel is a type of gel from which the liquid has been removed in such a way as to minimize collapse or change in the structure as the water is removed.

Silica gel can be prepared conventionally such as by mixing an aqueous solution of an alkali metal silicate (e.g., sodium silicate) with a strong acid such as nitric or sulfuric acid, the mixing being done under suitable conditions of agitation to form a clear silica sol which sets into a hydrogel. The resulting gel can be washed. The concentration of the $SiO_2$ in the hydrogel is usually in a range of between about 10 to 60 weight percent, and the pH of the gel can be from about 1 to 9.

Washing can be accomplished by immersing the newly formed hydrogel in a continuously moving stream of water which leaches out the undesirable salts and other impurities that may reduce the activity of the catalyst, leaving essentially pure silica ($SiO_2$). The pH, temperature, and duration of the wash water can influence the physical properties of the silica, such as surface area and pore volume.

As described above, the nanoscale catalyst particles can be commercially available nanoscale catalyst particles. Commercially available nanoscale catalyst particles can be combined with an alumina-silica sol mixture that is gelled and dried to form the catalyst. The co-gel generally can be dried at a temperature of from about 100° C. to 200° C. for a period of time typically about 1 to 24 hours to form a powder catalyst. Alternatively, the nanoscale catalyst particles can be formed in situ from molecular organic decomposition (MOD) by combining a metal precursor solution with an alumina-silica sol mixture that is gelled and heated to form the catalyst. The nanoscale catalyst particles can be formed in situ during the step of heating, which comprises heating at a temperature sufficient to thermally decompose the metal precursor to form nanoscale catalyst particles.

The MOD process starts with a metal precursor containing the desired metallic element(s) dissolved in a suitable solvent. For example, the process can involve a single metal precursor bearing one or more metallic atoms or the process can involve a plurality of metallic precursors that are combined in solution to form a solution mixture. As described above, MOD can be used to prepare nanoscale metal particles and/or nanoscale metal oxide particles.

Nanoscale catalyst particles can be obtained from a single metal precursor, mixtures of metal precursors or from single-source metal precursor molecules in which two or more metallic elements are chemically associated. The desired stoichiometry of the resultant particles can match the stoichiometry of the metal precursor solution. For example, nanoscale catalyst particles of iron oxide can be formed from thermal decomposition of a metal precursor containing iron such as iron isopropoxide. Nanoscale catalyst particles of iron aluminide can be formed from thermal decomposition of a mixture of a metal precursor containing iron and a metal precursor containing aluminum or from thermal decomposition of a metal precursor containing iron and aluminum.

The decomposition temperature of the metal precursor is the temperature at which the ligands substantially dissociate (or volatilize) from the metal atoms. During this process the bonds between the ligands and the metal atoms are broken such that the ligands are vaporized or otherwise separated from the metal. Preferably all of the ligand(s) decompose. However, nanoscale catalyst particles may also contain carbon obtained from partial decomposition of the organic or inorganic components present in the metal precursor and/or solvent. Preferably the nanoscale catalyst particles are carbon-free.

The metal precursors used in MOD processing preferably are high purity, non-toxic, and easy to handle and store (with long shelf lives). Desirable physical properties include solubility in solvent systems, compatibility with other precursors for multi-component synthesis, and volatility for low temperature processing.

The metal precursor compounds for making nanoscale catalyst particles are preferably metal organic compounds, which have a central main group, transition, lanthanide, or actinide metal atom or atoms bonded to a bridging atom (e.g., N, O, P or S) that is in turn bonded to an organic radical. Examples of the main group metal atom include, but are not limited to Group IIIB elements (B, A1); Group IVB elements (C, Si, Ge, Sn); Group IVA elements (Ti, Zr, Hf); Group VA elements (V, Nb, Ta); Group VIA elements (Cr, Mo, W), Group VIIA elements (Mn, Re), Group VIIIA elements (Fe, Co, Ni, Ru, Rh, Pd, Os, Ir, Pt); Group IB elements (Cu, Ag, Au); Mg, Zn, Y and/or rare earth metals such as Ce. Such compounds may include metal alkoxides, β-diketonates, carboxylates, oxalates, citrates, metal hydrides, thiolates, amides, nitrates, carbonates, cyanates, sulfates, bromides, chlorides, and hydrates thereof. The metal precursor can also be a so-called organometallic compound, wherein a central metal atom is bonded to one or more carbon atoms of an organic group. Aspects of processing with these metal precursors to form nanoscale catalyst particles are discussed below.

Precursors for the synthesis of nanoscale oxide particles are molecules having pre-existing metal-oxygen bonds such as metal alkoxides $M(OR)_n$ or oxoalkoxides $MO(OR)_n$ (R=saturated or unsaturated organic group, alkyl or aryl), β-diketonates $M(\beta\text{-diketonate})_n$ (β-diketonate=RCOCHCOR') and metal carboxylates $M(O_2CR)_n$. Metal alkoxides have both good solubility and volatility and are readily applicable to MOD processing. Generally, however, these compounds are highly hydroscopic and require storage under inert atmosphere. In contrast to silicon alkoxides, which are liquids and monomeric, the alkoxides based on most metals are solids. On the other hand, the high reactivity of the metal-alkoxide bond can make these metal precursor materials useful as starting compounds for a variety of heteroleptic species (i.e., species with different types of ligands) such as $M(OR)_{n-x}Z_x$ (Z=β-diketonate or $O_2CR$).

Metal alkoxides $M(OR)_n$ react easily with the protons of a large variety of molecules. This allows easy chemical modification and thus control of stoichiometry by using, for example, organic hydroxy compounds such as alcohols, silanols ($R_3SiOH$), glycols. $OH(CH_2)_nOH$, carboxylic and hydroxycarboxylic acids, hydroxyl surfactants, etc.

Fluorinated alkoxides $M(OR_F)_n$ ($R_F$=$CH(CF_3)_2$, $C_6F_5$, . . . ) are readily soluble in organic solvents and less susceptible to hydrolysis than classical alkoxides. These materials can be used as precursors for fluorides, oxides or fluoride-doped oxides such as F-doped tin oxide, which can be used as metal oxide nanoscale catalyst particles.

Modification of metal alkoxides reduces the number of M—OR bonds available for hydrolysis and thus hydrolytic susceptibility. Thus, it is possible to control the solution chemistry by using, for example, β-diketonates (e.g. acetylacetone) or carboxylic acids (e.g. acetic acid) as modifiers for, or in lieu of, the alkoxide.

Metal β-diketonates $[M(RCOCHCOR')_n]_m$ are attractive precursors for MOD processing because of their volatility and high solubility. Their volatility is governed largely by the bulk of the R and R' groups as well as the nature of the metal, which will determine the degree of association, m, represented in the formula above. Acetylacetonates (R=R'=$CH_3$) are advantageous because they can provide good yields.

Metal β-diketonates are prone to a chelating behavior that can lead to a decrease in the nuclearity of these precursors. These ligands can act as surface capping reagents and polymerization inhibitors. Thus, nanoscale particles can be obtained after hydrolysis of $M(OR)_{n-x}(\beta\text{-diketonate})_x$. Acetylacetone can, for instance, stabilize nanoscale colloids. Thus, metal β-diketonate precursors are preferred for preparing nanoscale catalyst particles. Metal β-diketonate ligands can also adjust the UV absorption bands of precursors for photo-assisted techniques such as the patterning of coatings using UV-curing.

Metal carboxylates such as acetates ($M(O_2CMe)_n$) are commercially available as hydrates, which can be rendered anhydrous by heating with acetic anhydride or with 2-methoxyethanol. Many metal carboxylates generally have poor solubility in organic solvents and, because carboxylate ligands act mostly as bridging-chelating ligands, readily form oligomers or polymers. However, 2-ethylhexanoates ($M(O_2CCHEt_nBu)_n$), which are the carboxylates with the smallest number of carbon atoms, are generally soluble in most organic solvents.

The solvent(s) used in MOD processing are selected based on a number of criteria including high solubility for the metal precursor compounds; chemical inertness to the metal precursor compounds; rheological compatibility with the substrate material being used (e.g. the desired viscosity, wettability and/or compatibility with other rheology adjusters); boiling point; vapor pressure and rate of vaporization; and economic factors (e.g. cost, recoverability, toxicity, etc.).

Solvents that may be used in MOD processing include pentanes, hexanes, cyclohexanes, xylenes, ethyl acetates, toluene, benzenes, tetrahydrofuran, acetone, carbon disulfide, dichlorobenzenes, nitrobenzenes, pyridine, methyl alcohol, ethyl alcohol, propyl alcohol, isopropyl alcohol, butyl alcohol, chloroform and mineral spirits.

Solvents and liquids (e.g., $H_2O$) that may form during the steps of forming the slurry and/or gelling the slurry (e.g., hydrolysis and condensation reactions) may be substantially removed from the co-gel during or prior to thermally treating the metal precursor, such as by heating the co-gel at a temperature higher than the boiling point of the liquid or by reducing the pressure of the atmosphere surrounding the co-gel.

During the step of heating the co-gel, the thermal treatment causes decomposition of the metal precursor to dissociate the constituent metal atoms, whereby the metal atoms may combine to form a metal or metal oxide particle having an atomic ratio approximately equal to the stoichiometric ratio of the metal(s) in the metal precursor solution.

To form nanoscale catalyst particles via the thermal decomposition of a metal precursor, an alumina-silica sol mixture can be combined with a metal precursor solution and the resulting co-gel or dried co-gel can be heated in the presence or the substantial absence of an oxidizing atmosphere. Alternatively, the co-gel or dried co-gel can be heated in the presence of an oxidizing atmosphere (e.g., air, $O_2$ or mixtures thereof) and then heated in the substantial absence of an oxidizing atmosphere (e.g., He, Ar, $H_2$, $N_2$ or mixtures thereof).

The co-gel is preferably heated at a temperature equal to or greater than the decomposition temperature of the metal precursor. The preferred heating temperature will depend on the particular ligands used as well as on the degradation temperature of the metal(s) and any other desired groups which are to remain. However, the preferred temperature is from about 200° C. to 400° C., for example 300° C. or 350° C.

The alumina-silica sol mixture that forms the porous aluminosilicate matrix can be combined in any suitable ratio with nanoscale catalyst particles (or a metal precursor used to form nanoscale catalyst particles) to give a desired loading of nanoscale catalyst particles in the matrix. Gold hydroxide and an aluminosilicate co-gel can be combined, for example, to produce from 1% to 50% wt. %, e.g. 15 wt. % or 25 wt. %, gold dispersed within the aluminosilicate.

Regardless of the method of preparing a dispersion of nanoscale catalyst particles in the co-gelled aluminosilicate matrix the as-dried catalyst powder, which may contain amorphous nanoscale catalyst particles and/or an amorphous matrix, can be incorporated into smoking article compositions. Furthermore, the dried catalyst powder can be optionally calcined to form crystalline nanoscale catalyst particles and/or a crystalline matrix, which can be incorporated into smoking article compositions. Calcination can be performed in air or oxygen at a temperature of from about 425 to about 750° C., preferably at a temperature of from about 500° C. to about 575° C., over a period of from about 30 minutes to 10 hours. For example, by calcining an aluminosilicate co-gel matrix at a temperature of at least about 425° C., the resulting matrix may comprise α-alumina and/or β-alumina.

"Smoking" of a cigarette refers to heating or combustion of the cigarette to form smoke, which can be drawn through the cigarette. Generally, smoking of a cigarette involves lighting one end of the cigarette and, while the tobacco contained therein undergoes a combustion reaction, drawing the cigarette smoke through the mouth end of the cigarette. The cigarette may also be smoked by other means. For example, the cigarette may be smoked by heating the cigarette and/or heating using electrical heater means, as described in commonly-assigned U.S. Pat. Nos. 6,053,176; 5,934,289; 5,591,368 or 5,322,075.

The term "mainstream" smoke refers to the mixture of gases passing down the tobacco rod and issuing through the filter end, i.e., the amount of smoke issuing or drawn from the mouth end of a cigarette during smoking of the cigarette.

In addition to the constituents in the tobacco, the temperature and the oxygen concentration are factors affecting the formation and reaction of carbon monoxide and carbon dioxide. The majority of carbon monoxide formed during smoking comes from a combination of three main sources: thermal decomposition (about 30%), combustion (about 36%) and reduction of carbon dioxide with carbonized tobacco (at least 23%). Formation of carbon monoxide from thermal decomposition, which is largely controlled by chemical kinetics, starts at a temperature of about 180° C. and finishes at about 1050° C. Formation of carbon monoxide and carbon dioxide during combustion is controlled largely by the diffusion of oxygen to the surface ($k_a$) and via a surface reaction ($k_b$). At 250° C., $k_a$ and $k_b$, are about the same. At 400° C., the reaction becomes diffusion controlled. Finally, the reduction of carbon dioxide with carbonized tobacco or charcoal occurs at temperatures around 390° C. and above.

During smoking there are three distinct regions in a cigarette: the combustion zone, the pyrolysis/distillation zone, and the condensation/filtration zone. While not wishing to be bound by theory, it is believed that the nanoscale catalyst particles of the invention can target the various reactions that occur in different regions of the cigarette during smoking.

First, the combustion zone is the burning zone of the cigarette produced during smoking of the cigarette, usually at the lighted end of the cigarette. The temperature in the combustion zone ranges from about 700° C. to about 950° C., and the heating rate can be as high as 500° C./second. Because oxygen is being consumed in the combustion of tobacco to produce carbon monoxide, carbon dioxide, water vapor and various organic compounds, the concentration of oxygen is low in the combustion zone. The low oxygen concentrations coupled with the high temperature leads to the reduction of carbon dioxide to carbon monoxide by the carbonized tobacco. In this region, the nanoscale catalyst particles can convert carbon monoxide to carbon dioxide via both catalysis and oxidation mechanism. The combustion zone is highly exothermic and the heat generated is carried to the pyrolysis/distillation zone.

The pyrolysis zone is the region behind the combustion zone, where the temperatures range from about 200° C. to about 600° C. The pyrolysis zone is where most of the carbon monoxide is produced. The major reaction is the pyrolysis (i.e., the thermal degradation) of the tobacco that produces carbon monoxide, carbon dioxide, smoke components and charcoal using the heat generated in the combustion zone. There is some oxygen present in this region, and thus the nanoscale catalyst particles may act as a catalyst for the oxidation of carbon monoxide to carbon dioxide. The catalytic reaction begins at 150° C. and reaches maximum activity around 300° C.

In the condensation/filtration zone the temperature ranges from ambient to about 150° C. The major process in this zone is the condensation/filtration of the smoke components. Some amount of carbon monoxide and carbon dioxide diffuse out of the cigarette and some oxygen diffuses into the cigarette. The partial pressure of oxygen in the condensation/filtration zone does not generally recover to the atmospheric level.

The nanoscale catalyst particles will preferably be distributed throughout the tobacco rod and/or along the cigarette paper portions of a cigarette. By providing the nanoscale catalyst particles throughout the tobacco rod and/or along the cigarette paper, it is possible to reduce the amount of carbon monoxide drawn through the cigarette, and particularly at both the combustion region and in the pyrolysis zone.

The catalyst may be provided in the form of a paste, powder or in the form of a dispersion. The catalyst may be incorporated into a tobacco rod along the length of the tobacco rod by distributing the catalyst on the tobacco and/or cigarette paper using any suitable method. For example, catalyst in the form of a dry powder can be dusted on cut filler tobacco and/or cigarette paper. The catalyst may also be present in the form of a dispersion and sprayed on cut filler tobacco and/or cigarette paper. Cut filler tobacco may be coated with a dispersion containing the catalyst such as by immersing the tobacco in the dispersion. The catalyst may be added to cut filler tobacco stock that is supplied to the cigarette making machine or added to a formed tobacco column prior to wrapping cigarette paper around the tobacco column to form a tobacco rod. The catalyst can also be added to cigarette filter material during and/or after manufacture of the cigarette filter material.

The amount of the catalyst can be selected such that the amount of carbon monoxide in mainstream smoke is reduced during smoking of a cigarette. Preferably, the amount of the nanoscale catalyst particles will be a catalytically effective amount, e.g., an amount sufficient to oxidize and/or catalyze at least 10% of the carbon monoxide in mainstream smoke, more preferably at least 25%. More preferably, the catalyst is added in an amount effective to reduce the ratio of carbon monoxide to total particulate matter in mainstream smoke by at least 10%, more preferably at least 25%.

One embodiment provides a smoking article composition comprising tobacco cut filler, cigarette paper and/or cigarette filter material further comprising a catalyst capable of converting carbon monoxide to carbon dioxide, wherein the catalyst comprises nanoscale catalyst particles dispersed within a porous aluminosilicate matrix.

Any suitable tobacco mixture may be used for the cut filler. Examples of suitable types of tobacco materials include flue-cured, Burley, Maryland or Oriental tobaccos, the rare or specialty tobaccos, and blends thereof. The tobacco material can be provided in the form of tobacco lamina, processed tobacco materials such as volume expanded or puffed tobacco, processed tobacco stems such as cut-rolled or cut-puffed stems, reconstituted tobacco materials, or blends thereof. The tobacco can also include tobacco substitutes.

In cigarette manufacture, the tobacco is normally employed in the form of cut filler, i.e., in the form of shreds or strands cut into widths ranging from about 1/10 inch to about 1/20 inch or even 1/40 inch. The lengths of the strands range from between about 0.25 inches to about 3.0 inches. The cigarettes may further comprise one or more flavorants or other additives (e.g., burn additives, combustion modifying agents, coloring agents, binders, etc.) known in the art.

Another embodiment provides a cigarette comprising a smoking article composition selected from tobacco cut filler, cigarette paper and/or cigarette filter material, wherein the smoking article composition further comprises a catalyst capable of converting carbon monoxide to carbon dioxide, wherein the catalyst comprises nanoscale catalyst particles dispersed within a porous aluminosilicate matrix.

Techniques for cigarette manufacture are known in the art. Any conventional or modified cigarette making technique may be used to incorporate the catalysts. The resulting cigarettes can be manufactured to any known specifications using standard or modified cigarette making techniques and equipment. Typically, the cut filler composition is optionally combined with other cigarette additives, and provided to a cigarette making machine to produce a tobacco rod, which is then wrapped in cigarette paper, and optionally tipped with filters.

Cigarettes may range from about 50 mm to about 120 mm in length. Generally, a regular cigarette is about 70 mm long, a "King Size" is about 85 mm long, a "Super King Size" is about 100 mm long, and a "Long" is usually about 120 mm in length. The circumference is typically from about 15 mm to about 30 mm, and preferably around 25 mm. The tobacco packing density is typically in the range of about 100 $mg/cm^3$ to about 300 $mg/cm^3$, and preferably about 150 $mg/cm^3$ to about 275 $mg/cm^3$.

EXAMPLE 1

A co-gelled nanoscale iron oxide-aluminosilicate catalyst was prepared as follows: Aluminum nitrate was dissolved in de-ionized water to give a 0.45M solution. An alumina sol was prepared by adding a 15% ammonium hydroxide solution under constant mixing to the aluminum nitrate solution to initiate the precipitation of alumina and increase the pH of the solution to about 10. An ion-exchanged silica sol was prepared by conventional ion exchange of sodium silicate solution (5 wt. %) at a pH of about 3. The pH of this sol was increased to about 10 by the addition of a 15% ammonium hydroxide solution. The alumina sol and the silica sol were combined together with NANOCAT® iron oxide particles at constant flow rates under constant agitation. The temperature of the resulting slurry was maintained at 50° C. and the pH was maintained in the region of about 9.5 to 10 by addition of ammonium hydroxide. Following 3 hours of reaction time, a co-gel was obtained by condensation of the slurry, which was aged for an additional 24 hours at 50° C., and dried to form a nanoscale iron oxide/aluminosilicate-containing powder catalyst. A dispersion of the catalyst in water was spray-coated onto cigarette filter material, tobacco cut filler and/or cigarette paper.

EXAMPLE 2

An alumina-silica sol was prepared as described in Example 1. Nanoscale cerium oxide ($CeO_2$) particles were added to the sol prior to condensation to give 5% by weight nanoscale $CeO_2$ particles in the slurry. The slurry was dried and aged as in Example 1 to form a nanoscale cerium oxide/aluminosilicate-containing powder catalyst. A dispersion of the catalyst in water was spray-coated onto cigarette filter material, tobacco cut filler and/or cigarette paper.

EXAMPLE 3

A solution of iron pentane dionate was mixed with the alumina-silica sol of Example 1. The mixture was co-gelled as described above in Example 1 and allowed to dry into a powder by heating to about 125° C. After drying, the metal precursor-aluminosilicate mixture was heated in air to 350° C., wherein thermal decomposition of the pentane dionate resulted in the formation of nanoscale iron oxide particles embedded in a porous aluminosilicate matrix. A dispersion of the catalyst in water was spray-coated onto cigarette filter material, tobacco cut filler and/or cigarette paper.

While preferred embodiments of the invention have been described, it is to be understood that variations and modifications may be resorted to as will be apparent to those skilled in the art. Such variations and modifications are to be considered within the purview and scope of the invention as defined by the claims appended hereto.

All of the above-mentioned references are herein incorporated by reference in their entirety to the same extent as if each individual reference was specifically and individually indicated to be incorporated herein by reference in its entirety.

What is claimed is:

1. A smoking article composition comprising tobacco cut filler, cigarette paper and/or cigarette filter material further comprising a catalyst capable of converting carbon monoxide to carbon dioxide, wherein the catalyst comprises nanoscale catalyst particles dispersed within a porous aluminosilicate matrix, and wherein the nanoscale catalyst particles comprise iron oxide, and/or iron oxide hydroxide, and/or wherein the matrix further comprises magnesia, titania, yttria, ceria or mixtures thereof.

2. The smoking article composition of claim 1, wherein the nanoscale catalyst particles are:

bound to the porous aluminosilicate matrix by forming the aluminosilicate matrix around the nanoscale catalyst particles, and/or blended and uniformly cast into an aluminosilicate matrix.

3. The smoking article composition of claim 1, wherein the nanoscale catalyst particles comprise a Group IIIB element, a Group IVB element, a Group IVA element, a Group VA element, a Group VIA element, a Group VIIA element, a Group VIIIA element a Group IB element, magnesium, zinc, yttrium, a rare earth metal, and mixtures thereof.

4. The smoking article composition of claim 1, wherein the nanoscale catalyst particles comprise iron oxide.

5. The smoking article composition of claim 1, wherein the nanoscale catalyst particles comprise iron oxide hydroxide.

6. The smoking article composition of claim 1, wherein the nanoscale catalyst particles are carbon free.

7. The smoking article composition of claim 1, wherein the nanoscale catalyst particles have an average particle size less than about 50 nm.

8. The smoking article composition of claim 1, wherein the nanoscale catalyst particles have an average particle size less than about 10 nm.

9. The smoking article composition of claim 1, wherein the nanoscale catalyst particles have a crystalline structure.

10. The smoking article composition of claim 1, wherein the nanoscale catalyst particles have an amorphous structure.

11. The smoking article composition of claim 1, wherein the matrix further comprises magnesia, titania, yttria, ceria or mixtures thereof.

12. The smoking article composition of claim 1, wherein the matrix structure is crystalline.

13. The smoking article composition of claim 1, wherein the matrix has an amorphous structure.

14. The smoking article composition of claim 1, wherein the matrix has an average pore size of between about 1 nanometer and 100 nanometers.

15. The smoking article composition of claim 1, wherein the matrix has an average surface area of from about 20 to 2500 $m^2/g$.

16. The smoking article composition of claim 1, wherein the catalyst comprises from about 1 to 50 wt. % iron oxide particles.

17. The smoking article composition of claim 1, wherein the catalyst is added in an amount effective to reduce the ratio of carbon monoxide to total particulate matter in mainstream smoke by at least 25%.

18. The smoking article composition of claim 1, wherein the catalyst is capable of acting as an oxidant for the conversion of carbon monoxide to carbon dioxide.

19. A cigarette comprising the smoking article composition of claim 1.

20. A method of making a smoking article composition comprising tobacco cut filler, cigarette paper and/or cigarette filter material further comprising a catalyst, comprising the steps of:

combining nanoscale catalyst particles or a metal precursor solution thereof with an alumina-silica sol mixture to form a slurry, gelling the slurry to form a co-gel, heating the co-gel to form a catalyst comprising nanoscale catalyst particles dispersed within a porous aluminosilicate matrix; and incorporating the catalyst in tobacco cut filler, cigarette paper and/or cigarette filter material.

21. The method of claim 20, wherein nanoscale catalyst particles comprising a metal and/or a metal oxide are combined with the alumina-silica sol mixture.

22. The method of claim 20, wherein nanoscale catalyst particles comprising a Group IIIB element, a Group IVB element, a Group IVA element, a Group VA element, a Group VIA element, a Group VIIA element, a Group VIIIA element, a Group IB element, magnesium, zinc, yttrium, a rare earth metal, and mixtures thereof are combined with the alumina-silica sol mixture.

23. The method of claim 20, wherein nanoscale catalyst particles comprising iron oxide are combined with the alumina-silica sol mixture.

24. The method of claim 20, wherein nanoscale catalyst particles comprising iron oxide hydroxide are combined with the alumina-silica sol mixture.

25. The method of claim 20, wherein nanoscale catalyst particles having an average particle size less than about 50 nm are combined with the alumina-silica sol mixture.

26. The method of claim 20, wherein nanoscale catalyst particles having an average particle size less than about 10 nm are combined with the alumina-silica sol mixture.

27. The method of claim 20, wherein nanoscale catalyst particles having a crystalline structure are combined with the alumina-silica sol mixture.

28. The method of claim 20, wherein nanoscale catalyst particles having an amorphous structure are combined with the alumina-silica sol mixture.

29. The method of claim 20, wherein a metal precursor solution comprising a metal precursor selected from the group consisting of β-diketonates, dionates, oxalates and hydroxides is combined with the alumina-silica sol mixture.

30. The method of claim 20, wherein a metal precursor solution comprising a Group IIIB element, a Group IVB element, a Group IVA element, a Group VA element, a Group VIA element, a Group VIIA element, a Group VIIIA element, a Group IB element, magnesium, zinc, yttrium, a rare earth metal, and mixtures thereof is combined with the alumina-silica sol mixture.

31. The method of claim 20, wherein the nanoscale particles or the metal precursor solution are combined with an alumina-silica sol mixture further comprising magnesia, titania, yttria and/or ceria.

32. The method of claim 20, wherein the nanoscale particles or the metal precursor solution are combined with an alumina-silica sol mixture comprising an aluminum source selected from the group consisting of aluminum nitrate, aluminum chloride and aluminum sulfate and a silicon source selected from the group consisting of silica hydrogels, silica sols, colloidal silica, fumed silica, silicic acid and silanes.

33. The method of claim 20, wherein the step of forming the slurry and gelling the slurry are performed simultaneously.

34. The method of claim 20, wherein the step of gelling the slurry is conducted at a pH of at least about 7.

35. The method of claim 20, wherein the step of gelling the slurry is conducted by adding a ammonium hydroxide to the slurry to bring the pH in a range of from between about 8 to 11.

36. The method of claim 20, wherein the step of gelling the slurry is conducted at a temperature of less than about 100° C.

37. The method of claim 20, wherein the step of heating is conducted at a temperature in a range of from about 200° C. to 500° C.

38. The method of claim 20, wherein the step of heating comprises heating the co-gel at a temperature sufficient to thermally decompose the metal precursor to form nanoscale catalyst particles.

39. The method of claim 20, further comprising the step of calcining the catalyst powder at a temperature in a range of from about 425 to 750° C.

40. The method of claim 20, wherein the step of incorporating comprises spray coating, dusting and immersion.

41. The method of claim 20, wherein the co-gel is heated at a temperature sufficient to form nanoscale catalyst particles and/or an aluminosilicate matrix having a crystalline structure.

42. The method of claim 20, wherein the co-gel is heated at a temperature sufficient to form carbon-free nanoscale catalyst particles.

43. The method of claim 20, wherein the co-gel is heated at a temperature sufficient to form nanoscale catalyst particles and/or an aluminosilicate matrix having an amorphous structure.

44. The method of claim 20, wherein a slurry comprising from about 1 to 50 wt. % iron oxide nanoscale catalyst particles is gelled to form the co-gel.

45. The method of claim 20, wherein the catalyst is added to the smoking article composition in an amount effective to reduce the ratio of carbon monoxide to total particulate matter in mainstream smoke by at least 25%.

46. The method of claim 20, wherein the catalyst is added to the smoking article composition in an amount effective to catalyze and/or oxidize the conversion of carbon monoxide to carbon dioxide.

47. A method of making a cigarette comprising the steps of:

supplying tobacco cut filler to a cigarette making machine to form a tobacco column; and placing cigarette paper around the tobacco column to form a tobacco rod of the cigarette, wherein at least one of the tobacco cut filler and cigarette paper wrapper are made according to the method of claim 20.

48. A method of smoking the cigarette of claim 19, comprising lighting the cigarette to form tobacco smoke and drawing the tobacco smoke through the cigarette, wherein during the smoking of the cigarette the catalyst reduces the amount of carbon monoxide in the tobacco smoke.

* * * * *